United States Patent [19]

Jour et al.

[11] Patent Number: 4,660,398

[45] Date of Patent: Apr. 28, 1987

[54] PROCESS FOR CONTROLLING A ROLLING MILL HAVING OBLIQUE ROLLS AND A ROLLING MILL FOR CARRYING OUT THIS PROCESS

[75] Inventors: Jean-Marc Jour, Aulnoye-Aymeries; Pierre Peytavin, Neuilly/sur/Seine, both of France

[73] Assignee: Vallourec S.A., France

[21] Appl. No.: 716,345

[22] Filed: Mar. 26, 1985

[30] Foreign Application Priority Data

Mar. 28, 1984 [FR] France ..... 84 05424

[51] Int. Cl.[4] ..... B21B 31/16

[52] U.S. Cl. ..... 72/100; 72/95

[58] Field of Search ..... 72/100, 78, 95, 96

[56] References Cited

U.S. PATENT DOCUMENTS

| | | | |
|---|---|---|---|
| 1,234,245 | 7/1917 | Wolffgram | 72/100 |
| 4,116,032 | 9/1978 | Krapfenbauer et al. | 72/100 |
| 4,242,894 | 1/1981 | Von Dorp et al. | 72/96 |

FOREIGN PATENT DOCUMENTS

| | | | |
|---|---|---|---|
| 380376 | 5/1973 | U.S.S.R. | 72/100 |
| 538797 | 12/1976 | U.S.S.R. | 72/100 |
| 598669 | 3/1978 | U.S.S.R. | 72/100 |
| 655440 | 4/1979 | U.S.S.R. | 72/100 |
| 733748 | 5/1980 | U.S.S.R. | 72/95 |

*Primary Examiner*—Lowell A. Larson

*Attorney, Agent, or Firm*—McDougall, Hersh & Scott

[57] ABSTRACT

The invention relates to a process for controlling a rolling mill having oblique rolls which is used for rolling metal rods or tubes, and to the rolling mill for carrying out the process. The rolling mill according to the invention comprises at least three rolls distributed round the rolling axis, each of the rolls having a profile generated by revolution of decreasing cross-section, the roll axes not intersecting the rolling axis, and each of the rolls exerting on the product a pressure which permits helicoidal rolling to be carried out. The process involves controlling the forward feed while keeping the angle of inclination of each of the axes of revolution of the rolls constant relative to a secant straight line, the so-called control axis, which is a straight line perpendicular to the rolling axis and intersecting said rolling axis and which traverses the zone of contact between the roll and the product to be rolled. The process also relates to a particular method of rolling in which combined variation of the feed angle and the gap between the rolls is effected during rolling.

7 Claims, 10 Drawing Figures

PROCESS FOR CONTROLLING A ROLLING MILL HAVING OBLIQUE ROLLS AND A ROLLING MILL FOR CARRYING OUT THIS PROCESS

The invention relates to a process for controlling a rolling mill having oblique rolls of the type used for rolling metal rods or tubes in order to achieve a high rate of reduction in a single pass. The invention also relates to a rolling mill for carrying out this control process.

A process of this type applies, in particular, to the hot rolling of rods or tubes made, for example, of steel.

French patent FR No. 1 576 091 describes, on pages 5 and 6 and in FIG. 2, a rolling mill having oblique rolls comprising three mushroom-shaped working rolls. These rolls are arranged inside a housing formed by a casing (30), to which there are fixed three roll supports (31) distributed round the axis of the material to be rolled. The housing is rotated about this axis by a motor of which the driving pinion acts on a toothed crown (37). Each roll (27) is rotated about its axis (36) by a planetary system comprising a toothed crown (32) fixed on a hollow shaft inside which the material to be rolled travels.

Three satellite systems mesh with this toothed crown and each causes a roll such as (27) to rotate by means of a pair of bevel wheels (35). One of these wheels is mounted on the axis of the satellite (34) and the other on the axis (36) of the rolling roll.

The method of controlling a rolling mill of this type so as to adjust the feed of the desired value, in particular as a function of the rolled diameter, is described in the article by E. J. F. E. Breitschneider published in Iron and Steel Engineer (October 1981 pages 51 to 54). It involves (see page 51 left-hand column) causing the axes of each roll to rotate about the axes of the corresponding satellite so as to obtain the desired degree of inclination which permits the forward feed. This rotation of one axis about the other is effected without altering the angle between these two axes which is imposed by design and may be, for example, 60° (see page 52, left-hand column). According to the author, this inclination permitting forward feed can vary from 0° to 10°.

Furthermore, FR No. 1 576 091 describes a method of controlling the rolling diameter. This method involves causing each working roll to slide along its axis (36), acting on an approach device (38) which enables the outlet section for the material to be rolled to be varied.

Control of rolling mill rolls of this type by these two methods has serious disadvantages. In fact, control of the forward feed which is effected by causing the axis of each roll to rotate about the axis of the corresponding satellite causes a shifting of the working zone of each roll in contact with the product. This transverse shifting is due to the fact that, the more the feed angle is increased, the more the roll moves from the plane of symmetry passing through the rolling axis and the axis of the satellite. This causes disturbance of the rolling conditions which, in such a process, are particularly critical and should be adapted for high precision adjustment. Control of the outlet cross-section, obtained by sliding the roll along its axis, also has the disadvantage of shifting the rolling zone along the rolling axis. A combination of this axial shifting with the transverse shifting resulting from control of the forward feed disturbs the rolling conditions even more and therefore harms the quality of the product, particularly with regard to the surface state and, in the case of a tube, the uniform thickness.

French Pat. No. 1 475 645 describes a different type of oblique rolling mill having three rolls in which control of the distance between the rolls and the rolling axis and control of the feed angle are combined. For this purpose, each roll is mounted on two bearings arranged on either side of the roll. FIG. 1 of this document shows that this combined control is effected by rotating round the rolling axis an end plate which bears the three bearings located on the same side of the rolls.

It is thus possible, during rolling, in particular at the end of rolling a tube blank, simultaneously to vary the distance between the rolls and the feed angle so as to avoid, in particular, tearing of the blanks and even blockages. This possibility is particularly important when the cross-sections are to be reduced at high rates.

This method of control has the disadvantage of causing a transverse shifting of the working zone of each roll in contact with the product. Moreover, as seen in FIGS. 1 to 6 of this document, the method applies to rolling mills whose roll axis is inclined only slightly to the rolling axis.

The present invention aims at developing a process for controlling a rolling mill having oblique rolls which enables the forward feed of the product to be controlled substantially independently of the other control parameters during rolling. The possibility of varying the diameter of the rolled products obtained within wide limits while maintaining optimum rolling conditions, in particular while using the same set of rolls has also been investigated.

The invention aims also at developing a process for controlling a rolling mill having three rolls of which the roll axes are inclined by at least 30° relative to the rolling axes has also been investigated.

The invention aims also at developing a rolling mill allowing the application of such a control process, and having a structure as compact and as sturdy as possible, and also requiring a minimum of ground space.

The control process according to the invention provides a particularly effective solution to these problems. It can be applied to rolling mills having oblique rolls, which are used for rolling metal rods or tubes, comprising at least three rolls distributed round the rolling axis, each of the rolls having a profile of revolution of generally decreasing cross-section, at least in the portion allowing reduction of the external diameter of the product, from the entry side of the product to be rolled to the outlet side of this product and exerting a pressure on this product via its contact zone so as to deform it. In such a rolling mill, the axis of revolution of each roll is inclined by an angle of inclination of between 20° and 70° to a straight secant line intersecting the axis of revolution of said roll, this straight line being perpendicular to the rolling axis and intersecting said rolling axis. This axis of revolution is orientated so as to approach the rolling axis in the direction of the outlet zone of the rolled product from the rolling mill. The process involves adjusting the forward feed by keeping constant the angle of inclination of the axis of revolution of each roll relative to a control axis constituted by a secant straight line as defined above and so selected that it traverses the zone of contact between the roll and the product to be rolled in the calibration zone of the product, and by rotating the axis of revolution of each roll about the corresponding control axis, until the feed angle A between the rolling axis and the projection of the axis of revolution on the plane passing through the rolling axis and perpendicular to the control axis attains the desired value.

The feed angle A is preferably adjusted between 3° and 30°.

In a complementary manner, the diameter of the rolled products obtained is controlled by moving each roll along the control axis without changing the angle of inclination of the axis of revolution relative to the control axis. It is advantageous if the rolls of the same rolling mill are identical and if their axes of revolution are inclined by the same angle to the corresponding control axes. It is also advantageous if the control axes meet at the same point on the rolling axis.

The invention also relates to a rolling mill corresponding to the general characteristics just given, which is provided with roll-bearing housings in which there are arranged, inside each of the housings, bearings which support the axis of revolution of a roll, said axis being connected by a transmission means to a rotary drive means, the housing itself being mounted rotatably about a control axis, perpendicular to the rolling axis intersecting said rolling axis, said control axis intersecting also the axis of revolution of the roll and traversing the zone of contact between the roll and the product to be rolled in the calibration zone of the product. A positioning means enables the housing to be oriented around the control axis and to be set angularly in a position such that the projection of the axis of revolution on the plane passing through the rolling axis and perpendicularly to the control axis forms the desired feed angle A with the rolling axis.

Means for shifting and locking advantageously enable each of the housings to be moved parallel to itself along the control axis, the corresponding roll being moved simultaneously, and enables the housing to be fixed at any position along this control axis.

Advantageously according to known practice, each roll comprises a calibration zone at the end of the zone for shaping by reduction.

The control axis advantageoulsy passes through the surface of the roll into a zone of this roll corresponding to the calibration zone and preferably to the middle of the calibration zone.

It is also advantageous if each roll is driven by means of a pair of conical toothed pinions, via a driving shaft arranged either in the extension of the control axis or in a direction parallel or nearly parallel to the rolling axis.

The rolling mill according to the invention can comprise housings which are rotated about the rolling axis at an equal speed, and in the opposite direction, to the speed of rotation of the rod or tube being rolled. In this case, each roll can be driven by planetary and satellite gears. A cardan joint or the like is therefore used between the satellite-bearing shaft and the driving shaft of each roll to compensate for the distance between this shaft and a position in which it is parallel with the rolling axis.

The invention also relates to a rolling mill having oblique rolls which enables the control process according to the invention to be carried out in a particularly advantageous manner. This rolling mill comprises a first means for controlling the distance between each roll and the rolling axis in the region of each roll-bearing housing. This first means comprises a nut and bolt assembly which is centered on the control axis, the one of the two components, preferably the bolt, being arranged at the periphery of the roll-bearing housing integrally therewith. The second component is mounted freely rotatably on a bearing which is fixed relative to the frame of the rolling mill. A rotary drive means enables this second component to be rotated relative to the first component by the desired amount so as to shift the roll-bearing housing the desired length along the control axis. The interval of rotation of the second component relative to the first component is advantageously less than two turns.

The freely rotatable component of the nut and bolt assembly preferably comprises a toothed crown which can be rotated by a first driving means which actuates a toothed pinion meshing with this crown. The bolt of the nut and bolt assembly is preferably also constituted by a screw-thread produced on the periphery of the roll-bearing housing, the nut being a crown nut mounted rotatably on a bearing connected in a fixed manner to the frame of the rolling mill.

In the region of each roll-bearing housing, a second control means preferably comprises a rotary drive means which permits the roll-bearing housing to be rotated about the control axis under the influence of a second driving means. The second driving means permits the roll-bearing housing to be orientated so as to give the roll the desired feed angle relative to the rolling axis. A locking means preferably prevents rotation of the freely rotating component of the nut and bolt assembly while the roll-bearing housing is being rotated about the control axis. The action of this locking means permits combined variation of the feed angle and the distance between the roll and the rolling axis by acting solely on the second control means.

The two components of the nut and bolt assembly can also be made integral when the second control means is actuated, causing only the feed angle to be varied.

Such an arrangement using a nut and bolt assembly at the periphery of the housing permits to obtain a very strongly built structure, very compact, and requiring a minimum of space in the radial direction.

For instance, the rotary drive means of each roll-bearing housing is a pivot fixed on the periphery of this housing on which a rod actuated by the second driving means is articulated. The second driving means is advantageously a jack. The pivot is advantageously mounted on a ring generated by revolution which is rotationally engaged on the roll-bearing housing and surrounds the nut and bolt assembly.

A means for synchronising the angular movements of the roll-bearing housing assembly connects these housings to each other so as to impose the same feed angle relative to the rolling axis on their rolls at each moment. This synchronisation means can, for instance, comprise articulated joints.

In the region of each roll-bearing housing, a pretensioning means advantageously permits the roll-bearing housing to rest on the framework by cancelling the existing clearance, in particular at the nut and bolt contact and in the region of the bearing against which th freely rotating component of the nut and bolt assembly rests. This pretensioning means advantageously comprises a traction means which is arranged along the control axis and is connected on one side to the roll-bearing housing and on the other side to the framework. This traction means exerts on the roll-bearing housing a force which is orientated parallel to the control axis and is directed towards this framework. This traction means is advantageously a jack.

A particularly effective operating method of the rolling mill of this design also forms part of the invention. It involves using, when rolling a tube blank, the second control means, so as to vary the feed angle and the distance between each roll and the rolling axis in a combined manner, the freely rotatable component of the nut and bolt assembly being prevented from rotating.

Owing to the arrangement according to the invention of the control axis, and to this combined variation device, it is possible, during the rolling of a tube blank, to vary simultaneously the feed angle, and the thickness of the tube, thus permitting the rolling up to the end without too large triangular deformations or even blockages. In this case the roll gap is increased, while the feed angle is lowered.

It is possible to use nut and bolt assemblies of which the pitch is adapted so as to adjust the ratio between the variation of the feed angle and the variation of roll gap to an optimum value. The first and second control means can also be actuated in a synchronised manner so as to superimpose on the variation of gap combined with the variation of feed angle an independent variation of the gap which may be added to or withdrawn from the first one, depending on the rotary drive direction of the freely rotating component of the nut and bolt assembly.

The detailed description as well as the following figures permit better understanding of, without limiting, the characteristics of the control process of a rolling mill having oblique rolls and those of the various embodiments of the rolling mill also forming part of the invention.

FIG. 1 shows a roll of a three roll oblique rolling mill equipped with the control device according to the invention in a schematic elevation and section.

Figure 1:
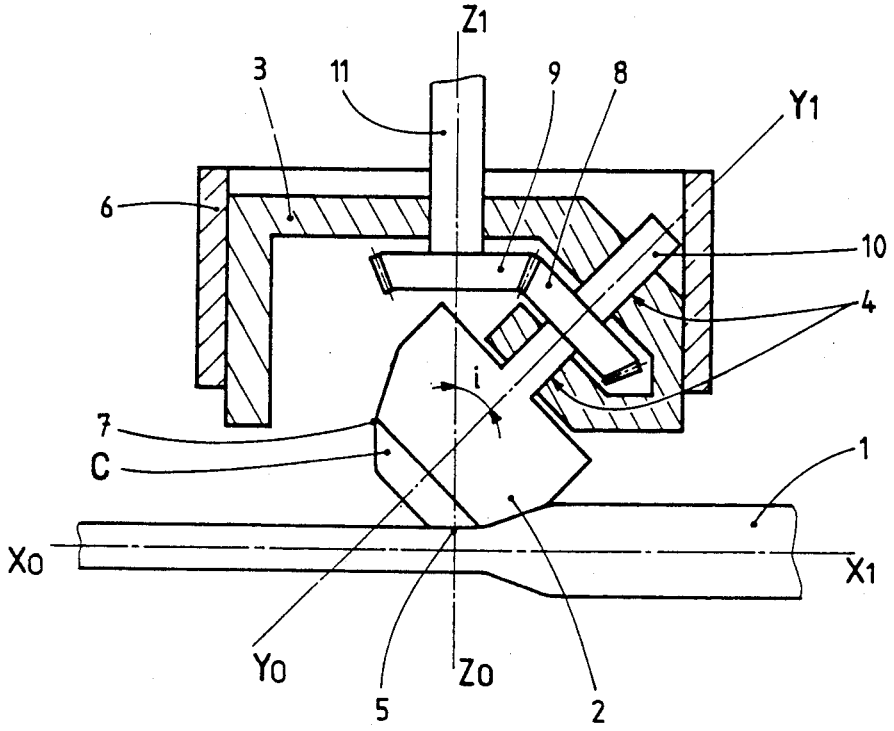
FIG. 1 shows an elevation and a section of a roll-bearing housing of an oblique rolling mill comprising control means according to the invention and equipped with a driving shaft which is mounted radially relative to the rolling axis.

This figure shows the rolling axis X0 X1 along which a tube or a rod of revolution 1 is being rolled.

The oblique roll 2 is mounted on an axis of rotation Y0 Y1 inside a housing 3 of generally cylindrical shape on which it rests on bearings 4.

The housing 3 is itself mounted rotatably about a control axis Z0 Z1, which is perpendicular to and intersects the axis X0 X1, said axis Z0 Z1 intersecting the axis Y0 Y1 and traversing the surface of the roll 2 in the zone of contact with the tube 1. In the case illustrated, the point 5 at which the axis Z0 Z1 passes through the surface of the roll is located in the calibration zone at the end of the zone of contact on the outlet side of the tube, in which zone the work of the roll involves essentially equalizing the cylindrical surface of the tube so as to eliminate undulations of helicoidal profile resulting from the forward feed.

Perpendicular axes X0 X1 and Z0 Z1 are within the plane of this figure 1 and the axis Y0 Y1 of roll 2 is inclined by reference to this plane, which it crosses at its point of intersection with the control axis Z0 Z1.

Figure 2:
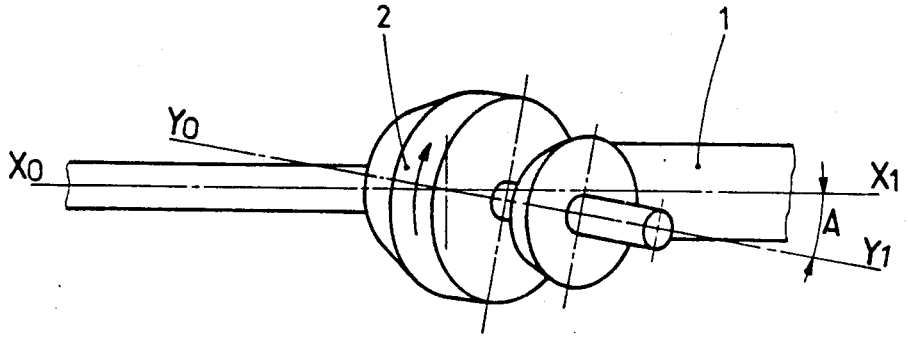
FIG. 2 is a plan view of the roll in FIG. 1 in the working position on a tube or rod during rolling.

FIG. 2 is a view from above along the axis Z0 Z1 of FIG. 1. The plane of that FIG. 2, perpendicular to the axis Z0 Z1 contains the axis X0 X1. The roll 2 and the tube or rod 1 are solely shown after removing the housing 3. This projection on the plane of the figure of the axis of revolution Y0 Y1 forms with the rolling axis X0 X1 an angle A.

This angle A is, by definition, the feed angle of roll 2 with respect to the rolling axis.

This angle is adjusted by rotating the housing (3) around the axis (Z0Z1). It can be for instance of 10°.

In FIG. 2, the roll 2 which is seen from above rotates in the direction of the arrow (clock-wise direction) and entrains the product along the axis X0 X1 from right to left.

As shown in FIG. 1, the angle of inclination i of the axis of revolution Y0 Y1 relative to the control axis Z0 Z1 is approximately 45°. This angle is fixed and is independent of the feed angle. It can vary from about 20° to about 70° depending on the rolling mill characteristics.

It is also observed that the axis of revolution Y0 Y1 is orientated so as to approach the rolling axis X0 X1 in the direction of the outlet zone of the rolled product from the rolling mill. By design, this axis does not intersect the rolling axis except when the feed angle A is equal to 0, which is never the case in the rolling position.

The roll 2 has a profile generated by revolution of which the cross-section decreases towards the outlet zone of the product to be rolled. In the calibration zone, the profile of the roll generatrix is determined so as to smooth the surface of the rod while attenuating or eliminating the helicoidal undulations which it may exhibit.

According to the invention, the feed angle A is controlled by rotating the housing 3 about the control axis Z0 Z1 until it has the desired angular orientation. In the case of FIG. 1, the feed angle A is adjusted to the desired value by rotating, using a known means (not shown), the housing 3 inside a fixed annular casing 6 which is in turn made integral with the fixed structure of the rolling mill which is not shown either.

An angular locking means (not shown) enables the housing 3 to be locked in a predetermined angular position inside the casing 6. It can be seen that owing to this process for controlling the feed angle according to the invention, it is possible to vary the feed angle within very wide limits without significantly disturbing the rolling conditions. In fact, it is observed that the rotation of the housing about the axis Z0 Z1 causes the roll to rotate in its zone of contact with the rod or the tube about a fixed point 5 which is on the control axis. This point 5 is normally situated in the calibration zone (C) of the roll. In FIG. 1, the reference numeral 7 represents the limit between the calibration zone (C) and the reduction zone on the roll.

Such possibilities are not afforded by known methods of control like the one described in the article published in "Iron and Steel Engineer" (October 1981, Pages 51 to 54).

It is also possible, according to the invention, to control the outlet diameter of the rolled products without significantly changing the rolling conditions. This is effected by sliding the roll-bearing housing 3 inside the fixed casing 6, along the axis Z0 Z1. Known means, not described, allow this sliding to be carried out and the housing 3 to be fixed axially in relation to the casing 6 at any point inside the control area.

This control by sliding parallel to the axis Z0 Z1 does not cause the roll to travel along the axis X0 X1 and does not cause its point of rotation 5 to move on contact with the product during rolling. This ensures that the feed angle A can be adjusted to fresh rolling conditions without significant disturbance. In fact, it is necessary to adapt the feed angle to the outlet diameter of the product if a good surface state is to be maintained.

Still with reference to FIG. 1, the roll 2 is rotated whatever the control position by a pair of toothed conical pinions 8 and 9. The pinion 8 is locked on the shaft 10 which drives the roll round the axis Y0 Y1. The pinion 9 is locked on the driving shaft 11 mounted on the axis Z0 Z1 which drives it by means of a driving means (not shown).

A rolling mill of this type comprises at least three housings such as the one shown in FIG. 1, of which the control axes such as Z0 Z1 are distributed round a rolling axis such as X0 X1. In the case of a three roll rolling mill, these axes such as Z0 Z1 are arranged at 120° to each other round the axis X0 X1 and converge.

The casings 6 usually occupy a fixed position in space enabling the driving shaft 11 to be driven by suitable driving means. The speeds of rotation of these shafts are preferably synchronised.

Figure 3:
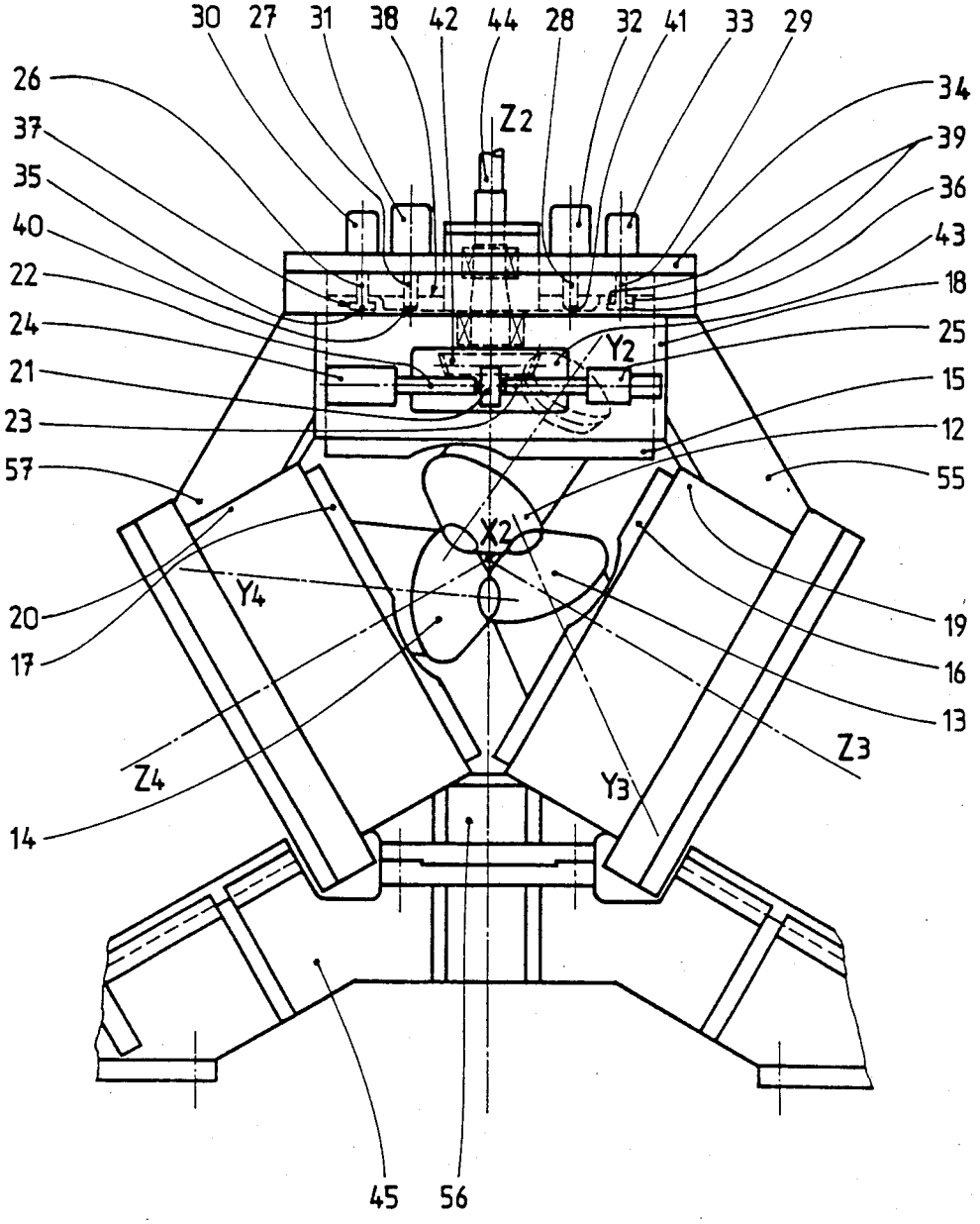
FIG. 3 is a view along the rolling axis on the outlet side of a three roll rolling mill equipped with control means according to the invention.

FIG. 3 is a view along the rolling axis on the side of which the rolled product leaves a rolling mill having three oblique rolls according to the invention. The rolling axis is perpendicular to the plane of the figure and intersects it at X2. Three rolls 12, 13, 14, of which the axes of revolution are Y2, Y3, Y4 are shown. These rolls are mounted in housings 15, 16, 17 having a cylindrical shape which are able to slide and rotate with a minimum of clearance inside annular casings 18, 19, 20 mounted integrally by means of parts 55, 56, 57.

Each of these housings is able to rotate about one of the three control axes Z2, Z3, Z4 perpendicular to the rolling axes and converging at X2 in the case illustrated. Each of these housings comprises the same control means according to the invention. These means are shown schematically in the case of the housing 15. The housing 15 comprises on its lateral wall a pin 21 which is held in an angular position determined by two stop screws 22, 23, which can be moved by engaging them more or less inside screw-threaded receptacles 24, 25 fixed on the casing 18. By screwing and unscrewing the stops, it is possible to move the pin transversely to the control axis Z2 and thus to rotate the housing 15 by a predetermined angle and to lock it in a very precise angular position. The feed angle is thus adjusted as described above.

Similarly, the housing 15 can be slided along the axis Z2 so as to control the outlet cross-section of the rolled rod.

Simple means for effecting this movement are constituted by adjustable stops.

The figure shows four stops comprising rods 26, 27, 28, 29 parallel to the axis Z2. The rods 27, 28 which are adjusting screws of adjustable length are screwed into screw-threaded sleeves 31, 32 fixed on a cover 34 which is perpendicular to Z2 and is integral with the casing 18. The rods 26, 29 which are hydraulic return rods of the jack rod type are mounted on members 30, 33 fixed on the cover 34 perpendicular to Z2 and integral with the casing 18. At the other end, the two rods 26, 29 comprise heads 35, 36 accommodated in an annular groove 37 having holding edges 39 formed on the upper face 38 of the housing 15. The two screw-threaded rods 27, 28 rest directly by means of their free ends 40, 41 on the face 38 while the rods 26, 29 exert a return force in the opposite direction.

It is understood that, by correctly controlling the rods 26, 27, 28, 29 it is impossible to slide the housing 15 axially and to lock it axially at any point on the axis Z2.

In a variation, the axial control device with stops, of the type described, can comprise instead of two adjusting screws such as 27, 28, a means for locking at three or more points instead of two, the return rods such as 26, 29 being connected as required.

Each of the housings 16, 17 is adjusted axially in the same way as the housing 15 by similar means (not shown). The three rolls 12, 13 and 14 are thus controlled with the same feed angle A relative to the rolling axis and the same gap from this axis.

Each roll is rotated by a pair of conical toothed pinions, 42, 43 shown in broken lines. Driving means (not shown) drive the driving shafts arranged radially along the control axes such as shaft 44.

A framework 45 holds the assembly in a fixed position. The products which are rolled by means of this rolling mill circulate through it while turning on themselves along the rolling axis.

As an example, tubes having a final external diameter of from 200 to 400 mm can be rolled using a rolling mill of the type described with reference to FIG. 3, equipped with three rolls of which the maximum diameter of the portion used during rolling is 800 mm, without changing the rolls.

If the rolls are mounted in such a way that the angle i is 60°, the final diameter is obtained by adjusting the feed angle A and the radial position of the rolls along their respective control axis Z2, Z3, Z4 for each diameter to be obtained.

Thus, for the above-mentioned dimensions, the feed angle can vary from A = 17° for a final external diameter of 219 mm to A = 11° for a final external diameter of 406 mm.

The following rolling conditions, when rolling on an internal mandrel, are used as an example:

(1) .Blank:
  external diameter = 270 mm
  thickness = 45 mm
for a finished tube:
  external diameter = 219 mm
  thickness = 8 mm
that is an elongation (length ratio of finished tube/-blank tube) of 6.

(2) .Blank:
  external diameter = 460 mm thickness = 50 mm
for a finished tube:
external diameter = 406 mm
thickness = 9.5 mm
that is an elongation of 5.4.

Figure 4:
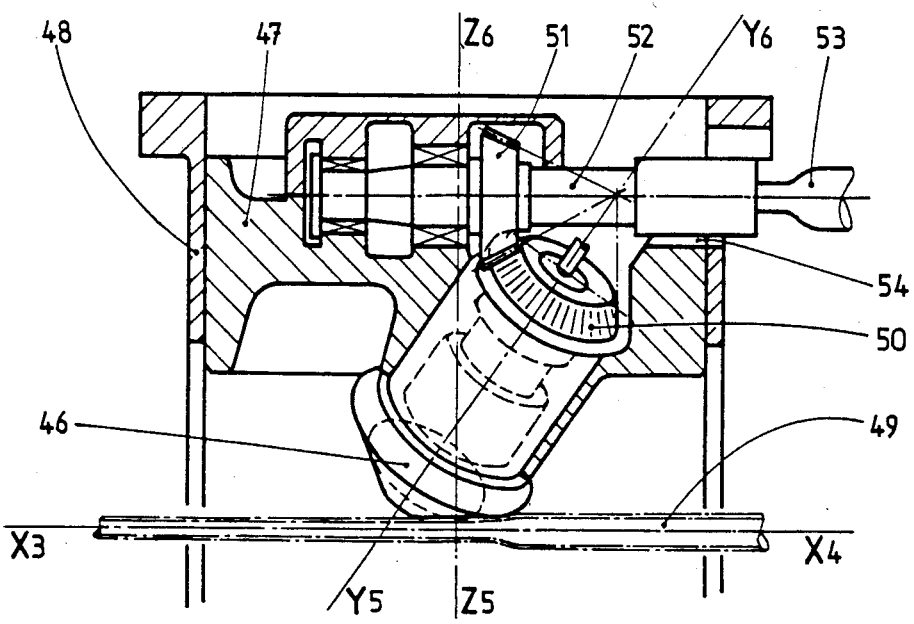
FIG. 4 shows an elevation and a section of a roll-bearing housing of an oblique rolling mill comprising control means according to the invention and equipped with a driving shaft perpendicular to the control axis.
Figure 5:
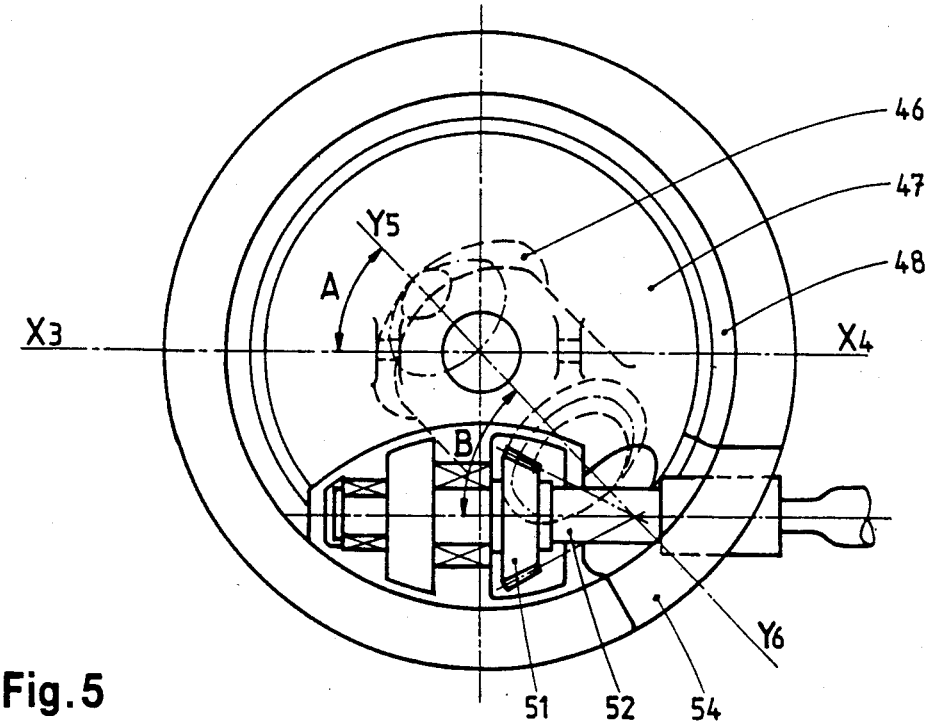
FIG. 5 is a plan view of FIG. 4.

FIGS. 4 and 5 show another embodiment of the process and the device according to the invention. This is a rolling mill having three oblique rolls of which a single roll is shown. FIG. 4 shows an elevation and section passing through the control axis. FIG. 5 is a plan view along the axis Z5 Z6 of FIG. 4. As in the previous figures, the roll 46 rotates about an axis of revolution Y5 Y6 inside a cylindrical housing 47. This housing can rotate about a control axis Z5 Z6, or can slide along it inside a fixed annular casing 48. The axis Z5 Z6 is perpendicular to and intersects the rolling axis X3 X4. It also intersects the axis of revolution Y5 Y6. As shown in FIG. 4, the control axis passes through the wall of the cylinder 46 in its zone of contact with the tube 49 during rolling according to the invention. The roll 46 is rotated by means of a pair of toothed conical pinions 50, 51. The pinion 51 is mounted on the driving shaft 52 which is perpendicular to the control axis Z5 Z6 and is driven by a motor (not shown).

This shaft 52 is mounted as close as possible to a parallel position relative to the rolling axis X3 X4, as shown in FIGS. 4 and 5. For this purpose, the shaft 52 is arranged by design inside the housing 47 so that, when projected on the plane in FIG. 5, it forms, with the projection on this same plane of the axis of revolution Y5 Y6, an angle B of which the value is close to the average value given to the angle A of the roll 46. This arrangement permits the driving shaft 52 to be connected to a driving means of which the shaft is substantially parallel to the rolling axis. However, to enable the feed angle A to be adjusted within the desired range of control, one or more articulated joints are provided such as cardan joints and lengthening pieces between the shaft 52 and the shaft of the driving means. Such a joint is shown schematically at 53. It is understood that if the angle B has been suitably selected, it is sufficient to be able to space the shaft 52 from the axis of the driving means shaft by an angle not exceeding half of the maximum feed angle A. The possibility of controlling A by rotating the housing 47 about the control axis Z5 Z6 is thus completely maintained. The movement of the shaft 52 is permitted by the scallop 54 made in the housing 47 and its casing 48.

With such an arrangement a three roll rolling mill can be built comprising housings which are themselves rotated about the rolling axis X3 X4 by their casings, which are in turn mounted rotatably about a fixed frame. By giving the housings an equal rotational speed in the direction opposite to that of the product being rolled it is possible to roll this product without causing it to rotate relative to the frame of the rolling mill. This facilitates introduction and extraction of the products being rolled which is particularly advantageous in the case of very long products. Owing to this arrangement it is also possible to drive each roll by planetary and satellite gears. it is sufficient to provide an articulated joint, for example a cardan joint, between the satellite-bearing shaft and the driving shaft of each roll, such as the shaft 52.

FIGS. 6 to 10 show another embodiment of a rolling mill having oblique rolls according to the invention which comprises particular means for controlling the gap between the rolls and the rolling axis as well as the feed angle of these rolls relative to said axis.

Figure 6:
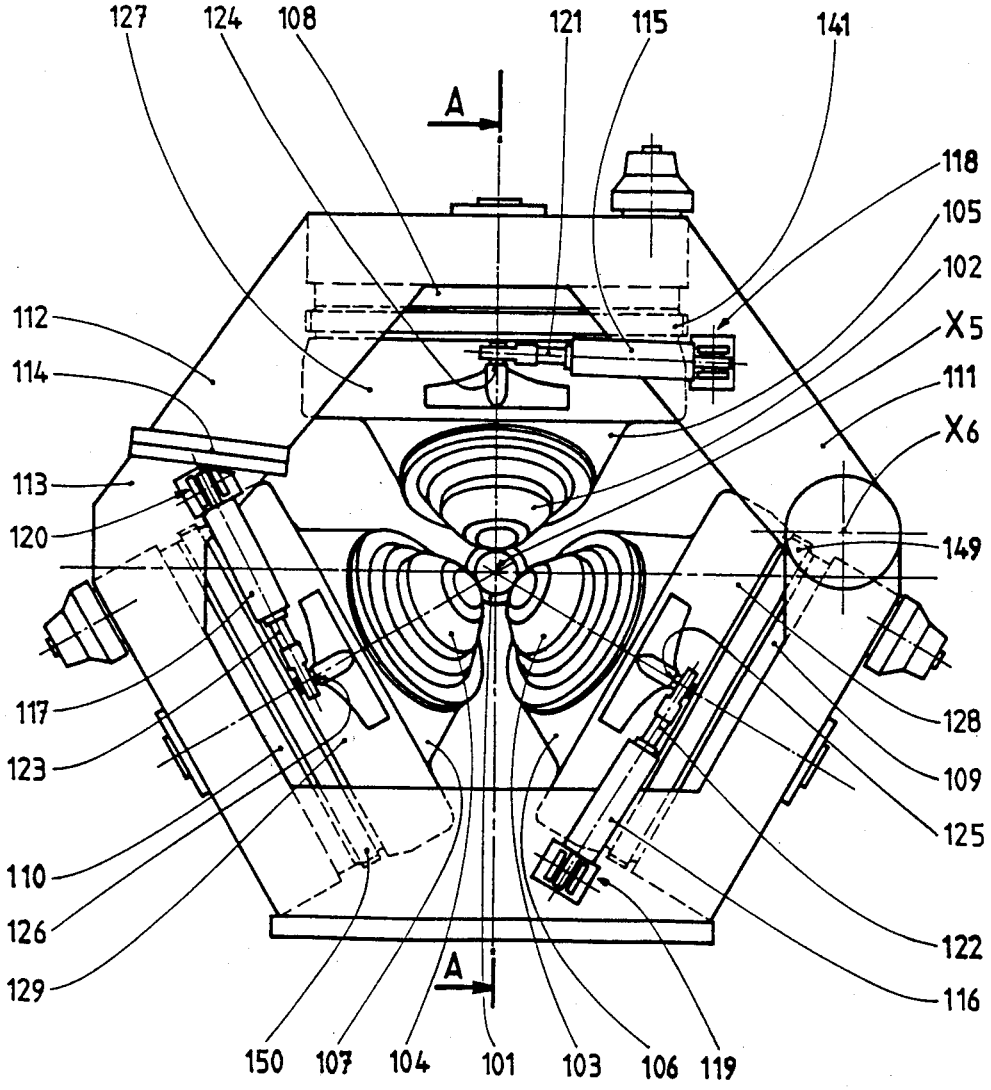
FIG. 6 is a schematic view of the downstream side of a rolling mill having oblique rolls, according to the invention, permitting the process according to the invention to be carried out in a particularly advantageous manner.

FIG. 6 is a general schematic view of the downstream side of a rolling mill having three oblique rolls according to the invention which is used for rolling a tube blank 101. The rolling axis X5 is perpendicular to the plane of the figure. The three rolls 102, 103, 104 are mounted in roll-bearing housings 105, 106, 107 which are in turn connected by base plates 108, 109 110 to the frame 111 of the rolling mill. This framework is in two portions which are articulated to each other round the axis X6 perpendicular to the plane of the figure. The ends 112, 113 of these two portions are held against each other at 114 by means of a jack (not shown). If excessive stresses exceeding the gripping force of the jack are applied during rolling, the framework is opened thus avoiding breaking parts.

Three hydraulic jacks 115, 116, 117 driven by means not shown enable the feed angle of the rolls 102, 103, 104 to be varied and also enable the gap between these rolls to be varied in an interconnected manner. The bodies of these jacks are articulated to the frame 111 at 118, 119, 120. Their rods 121, 122, 123 are articulated on pivots 124, 125, 126 fixed on rings 127, 128, 129 which themselves are integral with the respective roll-bearing housings 105, 106, 107. In this way, the jacks may permit rotation of the axes such as Y7 (see FIG. 7) of the rolls such as 102 about their control axes such as Z7.

Figure 7:
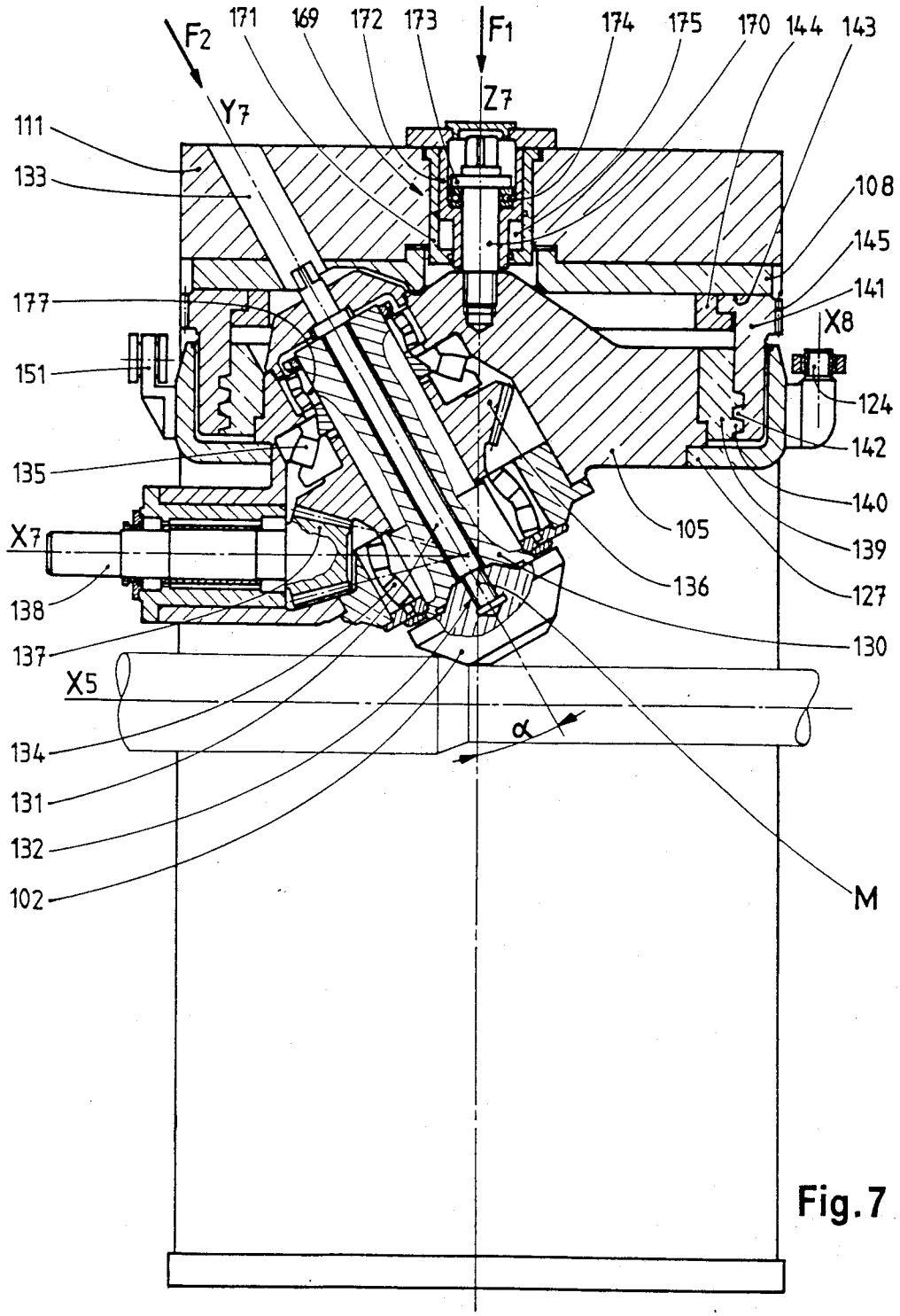
FIG. 7 is a section along line A—A in FIG. 6.

FIG. 7 is a sectional view of the roll-bearing housing 105 along a plane passing through the rolling axis X5 and through the control axis Z7 which are convergent and perpendicular according to the invention. The axis Y7 of the roll 102 intersects the control axis at M at an angle $\alpha$ of approximately 30°. This axis Y7 is shown in the plane of FIG. 7. It is inclined at an angle of approximately 60° to the rolling axis X5 in this condition, the feed angle being zero. The roll 102 is rotationally engaged with the roll-bearing shaft 130 by means of the rod having a screw-threaded end 131 which is screwed into the screw-threaded receptacle 132 of the roll 102. An opening 133 is made in the framework 111 for screwing or unscrewing the rod 131.

The roll-bearing shaft 130 is mounted rotatably about Y7 by means of bearing 134, 135, 177 resting on the roll-bearing housing 105. These bearings are designed in known manner to withstand the rolling stresses. The roll-bearing shaft 130 comprises a conical toothed crown 136 rotationally engaged with it, with which a conical pinion 137 mounted on a shaft 138 meshes. This arrangement is similar to the one shown in FIG. 4. In the case of the present FIG. 7, the axis X7 of the shaft 138 is in the plane of the figure. Under the rolling conditions, this axis forms with the plane of the figure an angle corresponding to the feed angle. The shaft 138 is connected in known manner to a driving shaft (not shown) by one or more articulated joints such as cardan joints which are not shown either.

The roll-bearing housing 105 comprises an annular zone 139 having an axis Z7 and provided with a male screw thread 140. This screw thread comprises less than three threads and its pitch is calculated so as to produce a predetermined relationship between the variation of feed angle and the interconnected variation of the roll gap relative to the rolling axis X5 which is to be obtained. This relationship depends mainly on the dimensions of the tube blanks, the mechanical prperties of the metal in the rolling conditions and the reduction rates to be achieved.

A nut ring 141 is provided with a female screw thread 142 meshing with the male screw thread 140 which is constituting the bolt of that nut and bolt assembly. The nut ring 141 is mounted freely rotatably on a bearing 143 which also comprises center ring and retaining ring 144 which centers the ring 141 relative to the axis Z7 and holds it against the base plate 108.

Figure 9:
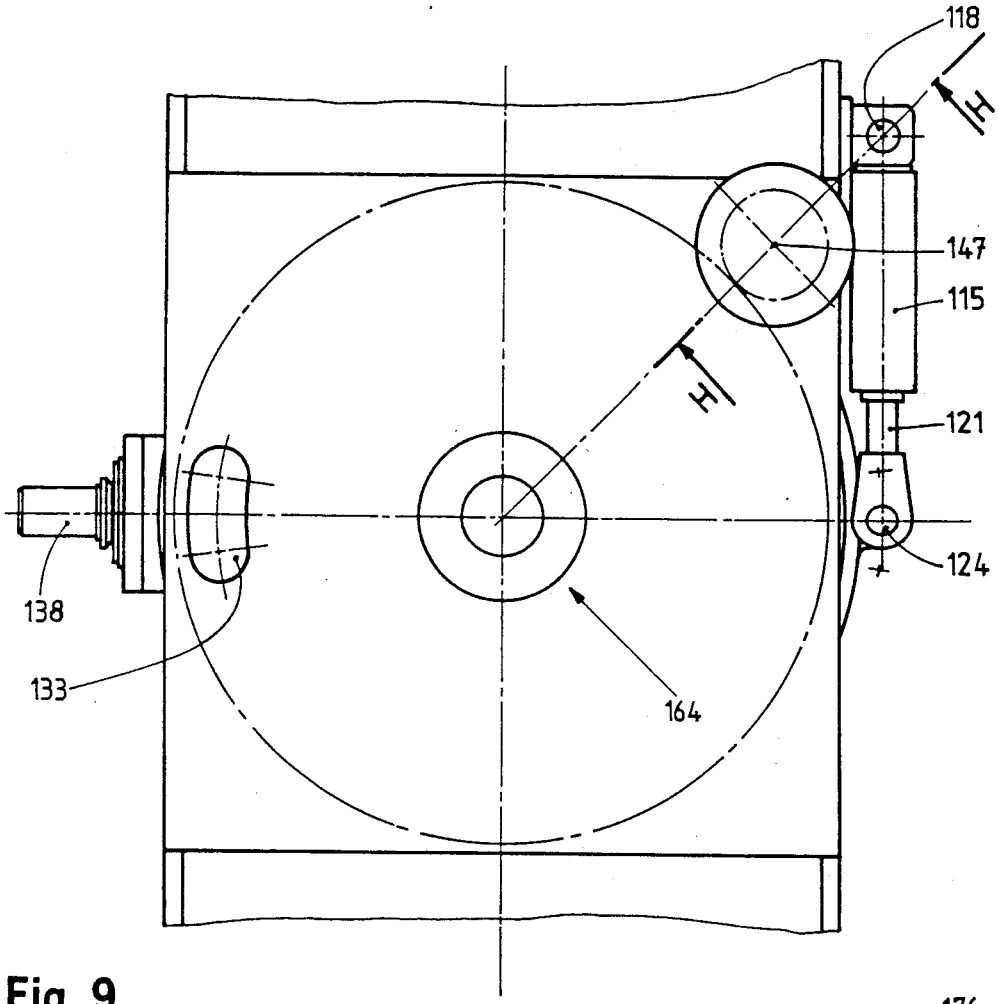
FIG. 9 is a plan view of FIG. 7.
Figure 10:
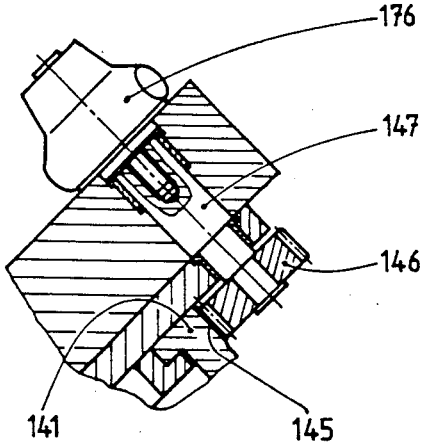
FIG. 10 is a partial sectional view along H—H in FIG. 9.

The nut ring 141 comprises a toothed crown 145 on which there meshes a toothed pinion 146 mounted on an axis 147 traversing the framework 111 and rotated by a first driving means such as the hydraulic motor 176 (see FIGS. 9 and 10). This arrangement is a first independent means of controlling the gap between the roll (102) and the rolling axis X5. In fact, for a given angular position of the roll-bearing housing 105 about the control axis, corresponding to a predetermined feed angle, the rotation of the nut ring 141 in one or other direction causes the roll-bearing housing 105 to move along the control axis and therefore causes a variation in the roll gap 102 relative to the rolling axis X5. The nut ring 141 can be driven in a known manner either in an independent manner by the first driving means or in combination with the drive of the two other nut rings 149, 150 which move each of the two other roll-bearing housings 106, 107.

The base plate 108 is fixed by known means such as screws (not shown) to the frame 111. The ring 127 which is mounted rotatably relative to the axis Z7 is rotationally engaged on the roll-bearing housing 105 and surrounds the nut and bolt assembly 140, 141.

The ring 127 comprises a control pivot 124 having an axis X8 parallel to Z7 on which the end of the rod 121 of the jack 115 shown in FIG. 6 is rotatably articulated.

The rotation of the ring 127 about the axis Z7 permits the feed angle and the gap of roll 102 relative to the rolling axis X5 to be controlled in an interconnected manner, the nut ring 141 being rotationally engaged by a known means. Thus, in the case shown in FIG. 7, rotation of the ring 127, viewed along F1, in a clockwise direction, causes the roll 102 to approach the axis X5 in the case of a nut and bolt assembly having a right-hand thread and causes the feed angle which is initially zero to increase.

The articulations of the jack rods 121, 122, 123 about the control pivots 124, 125, 126 and those 118, 119, 120 of the jack bodies 115, 116, 117 on the frame 111 are designed to enable the pivots 124, 125, 126 to move in known manner parallel to the axis Z7 within the limits of control of the roll gap relative to the axis X5.

Figure 8:
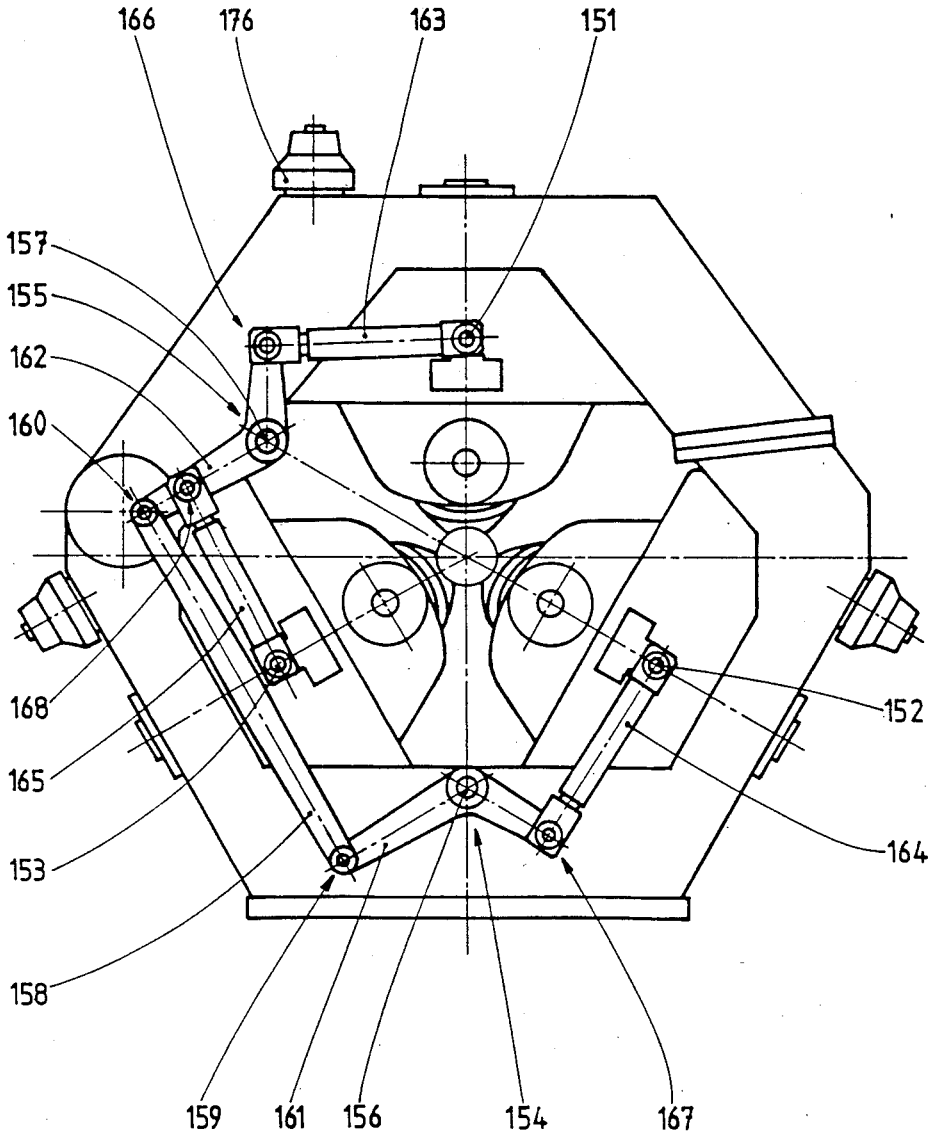
FIG. 8 is a schematic view of the upstream side of the rolling mill in FIG. 6.

The three synchronisation pivots 151, 152, 153 which are diametrically opposed to the three control pivots, permit the action of the three jacks 115, 116, 117 to be strictly synchronised. FIG. 8 shows the synchronisation means employed in the present rolling mill. Two levers which are bent at 120°, 154, 155 are each articulated about a pivot 156, 157 fixed on the frame 111 and having an axis parallel to X5. The axis of each of these pivots intersects a line which bisects the angle of 120° formed by two control axes. The angular movements of these levers 154, 155 are synchronised by a connecting rod 158 which is articulated at 159, 160, to the ends of the arms 161, 162 of these levers. The axes of the points of articulation 156, 159, 160, 157 are parallel to the rolling axis X5 and form the peaks of a deformable parallelogram. Each of the three synchronisation pivots 151, 152, 153 is connected to an arm of one of the two levers 154, 155 by an identical connecting rod 163, 164, 165 itself connected to one of the points of articulation 166, 167, 168. To cancel the clearance between the screw threads 140 and 142 and thus to prop each roll-bearing housing such as 105 against the frame 111, a pretensioning means such as 169 permits traction to be exerted on each housing along the control axis Z7 towards the frame 111. This device comprises a traction rod 170 having an axis Z7 which is screwed to the peak of the roll-bearing housing 105. This rod traverses a jack of which the body 171 is integral with the frame 111. An annular piston 172 slides in the body 171 and exerts a thrust on the collar 173 by means of the annular bearing 174 when a fluid under pressure is introduced into the annular chamber 175 through a pipe not shown. The collar 173 is integral with the rod 170.

The control process according to the invention as well as the various embodiments of a rolling mill employing this process can form the subject of numerous variations. These variations do not depart from the scope of the invention.

We claim:

1. A rolling mill for generating metal rods or tubes by revolution to achieve a high rate of reduction in a single pass, the rolling mill comprising:

a frame surrounding the rolling axis of the article to be reduced;

a plurality of housing distributed regularly around the rolling axis, rotatably supported on the frame, each housing being mounted about a control axis of the housing, said control axis being perpendicular to and intersecting the rolling axis at a point common for all control axes, each housing having an annular zone with a screw thread;

a shaft rotatably mounted on each housing with shaft axis intersecting the corresponding control axis, the shaft axis defining a feed angle formed by its projection on the plane passing through the rolling axis perpendicular to the corresponding control axis;

an oblique roll attached to the end of each shaft, the control axis of the housing corresponding to each shaft intersecting the surface of the corresponding roll in the zone where said roll is in contact with the product being rolled;

a nut ring rotatably mounted on the frame, the nut ring having screw thread engaging the screw thread of the annular zone of the housing to effect movement of the housing along and/or around its control axis upon relative rotational movement of the housing and nut ring;

nut ring rotation means to rotate the nut ring about the housing;

housing pivot means to rotate the housing independently of the nut ring;

whereby the feed angle and the distance from the oblique roll to the rolling axis may be varied according to a predetermined relationship by utilization of the housing pivot means and the distance from the oblique roll to the rolling axis can be varied independently of the feed angle by movement of the nut ring.

2. The rolling mill of claim 1 further comprising:

a pretensioning means between the frame and the housing to exert a force on the housing along the control axis.

3. The rolling mill of claim 1 further comprising:

shaft drive means supported in the housing for driving the shaft about its axis.

4. The rolling mill of claim 1 wherein the feed angle varies between about 3° and 30°.

5. The rolling mill of claim 1 wherein the nut ring rotation means comprises a toothed pinion mounted on the frame, the pinions engaging a toothed crown on the periphery of the nut ring.

6. The rolling mill of claim 1 wherein the housing pivot means comprises a hydraulic jack connected at one end to the frame and at the other end to a pivot attached to a rotation ring connected to the housing.

7. A rolling mill for generating metal rods or tubes by revolution to achieve a high rate of reduction in a single pass, the rolling mill comprising:

a frame surrounding the rolling axis of the article to be reduced;

a plurality of housings distributed regularly around the rolling axis and rotatably supported on the frame, each housing being mounted about a control axis of the housing, said control axis being perpendicular to and intersecting the rolling axis at a point common for all control axes, each housing having an annular zone with a screw thread;

a shaft rotatably mounted on each housing with shaft axis intersecting the corresponding control axis, and the shaft axis defining a feed angle formed by its projection on the plane passing through the rolling axis and perpendicular to the corresponding control axis;

shaft drive means supported in the housing for driving the shaft about its axis;

an oblique roll attached to one end of each shaft, the control axis of the housing corresponding to each shaft intersecting the surface of the corresponding roll in a zone where said roll is in contact with the product being rolled;

a nut ring rotatably mounted on the frame, the nut ring having screw thread engaging the screw thread of the annular zone of the housing to effect movement of the housing along and/or around its control axis upon relative rotational movement of the housing and nut ring;

a toothed pinion mounted on the frame engaging the periphery of the nut ring to rotate the nut ring about the housing control axis;

a jack connected at one end to the frame and at the other end to a pivot attached to a ring connected to the housing to rotate the housing about its control axis; and a pretensioning means between the frame and housing to exert a force on the housing along the control axis;

whereby the feed angle and the distance from the oblique roll to the rolling axis may be varied according to a predetermined relationship by utilization of the jack, and the distance from the oblique roll to the rolling axis can be varied independently of the feed angle by operation of the toothed pinion.

* * * * *